US005209378A

United States Patent [19]

Wiseburgh et al.

[11] Patent Number: 5,209,378

[45] Date of Patent: May 11, 1993

[54] LIQUID AERATING APPARATUS

[75] Inventors: Peter Wiseburgh, Jerusalem, Israel; Peter Hulley, Peterborough, England

[73] Assignee: Soda Club Holdings N.V., Curacao, Netherlands Antilles

[21] Appl. No.: 746,113

[22] Filed: Aug. 15, 1991

[30] Foreign Application Priority Data

Aug. 17, 1990 [IL] Israel ..... 95413

[51] Int. Cl.[5] ..... B65D 83/00

[52] U.S. Cl. ..... 222/397; 222/399; 141/64; 141/114; 220/722

[58] Field of Search ..... 222/52, 3, 129.1, 212, 222/213, 396, 397, 399, 402.15, 325; 220/720–722, 89.1; 141/46, 64, 114; 261/DIG. 7; 99/323.1

[56] References Cited

U.S. PATENT DOCUMENTS

| | | | |
|---|---|---|---|
| 3,685,694 | 8/1972 | Ianelii | 222/82 |
| 3,953,550 | 4/1976 | Gilbey | 222/397 |
| 4,082,123 | 4/1978 | Haythornthwaite et al. | 141/64 |
| 4,401,016 | 8/1983 | Adams et al. | 222/397 |
| 4,401,607 | 8/1983 | Child et al. | 261/DIG. 7 |
| 4,407,432 | 10/1983 | Shichmann | 222/397 |
| 4,610,282 | 9/1986 | Brooks et al. | 141/46 |

FOREIGN PATENT DOCUMENTS 435900 10/1967 Switzerland .

*Primary Examiner*—Andres Kashnikow
*Assistant Examiner*—Philippe Derakshani
*Attorney, Agent, or Firm*—Merchant & Gould, Smith, Edell, Welter & Schmidt

[57] ABSTRACT

An apparatus for aerating liquids contained in bottles includes a safety mechanism for detecting irregularities in the bottle and preventing undesired pressurization of a bottle having such irregularities. The apparatus includes a frame with a reference surface. A mechanism for holding the bottle in place causes the bottle to rest against the reference surface. Any irregularity in the bottle causing substantial angular displacement of the bottle activates a safety release valve in the mechanism, thus preventing over pressurization.

6 Claims, 6 Drawing Sheets

LIQUID AERATING APPARATUS

BACKGROUND OF THE INVENTION

This invention relates to apparatus for aerating liquids, and in particular to portable machines for preparing aerated beverages. More especially, the invention concerns such machines intended for use in the home and adapted to be operated manually.

In aerating machines of the foregoing kind, a bottle containing the liquid to be aerated is loaded onto the machine and gas is introduced into the machine and passed through the liquid contained in the bottle. The bottle is subsequently removed, when the aerating has been completed.

The gas used for aerating is supplied from a cylinder fitted to the machine, which is replaced when it has become exhausted. A valve is provided to control the flow of gas from the cylinder, which, in the case of rechargeable cylinders, may form part of the cylinder, or in the case of disposable cylinders may form part of the machine. When the valve is operated, gas may pass into the machine and through the liquid, generating an internal pressure inside the machine and bottle, which is limited to a given maximum level by a pressure relief and safety valve. When the aerating process has been completed, the pressure inside the machine and bottle is reduced to atmospheric level by opening a valve.

When plastic bottles are used, undesired and often dangerous phenomena may occur. Thus, if the pressure relief and safety valves malfunction while the machine is being operated, gas pressure may continue to build up inside the bottle to the point where the bottle material yields and the bottle expands in a ductile way. The bottle expansion takes place on the outside diameter, this being the most highly stressed area. In prior art machines, this expansion may continue until the bottle surface engages the internal profile of the surrounding cavity and pressurization continues to take place until bottle or machine failure results. This often causes explosion of the bottle and injury to the user may result. Prior art machines are incapable of preventing or controlling such harmful phenomena.

Even if the valves operate perfectly and no malfunction occurs, a bottle may be defective or become defective because of abuse in use. Distortion of the body shoulder or base shape coupled with a change in material properties may then occur. This can result in failure of the bottle when subjected to stresses caused by internal pressurization. Prior art machines will permit distorted bottles to be loaded in the normal manner and pressurized.

It is a purpose of this invention to provide apparatus for preparing aerated beverages which provides complete safety even when plastic bottles are used. More specifically, it is a purpose of this invention to provide such an apparatus which will not permit a bottle to be pressurized if it is dimensionally defective and in particular if it does not have the correct profile and is, e.g., larger or smaller than it should be.

It is another purpose of this invention to provide such an apparatus which will prevent explosion of the bottle or failure of the apparatus itself if a bottle yields and expands during pressurization.

It is a further purpose of the invention to provide an apparatus of the kind described which will prevent undesired and/or unsafe discharge of gas.

It is a still further purpose of the invention to provide an apparatus of the kind described, the safety features of which are operative even while the user actuates the aerating controls.

Other purposes and advantages of the invention will become apparent as the description proceeds.

SUMMARY OF THE INVENTION

The liquid aerating apparatus according to the invention is characterized in that it comprises safety means for detecting any irregularity in the shape and/or dimensions of the bottle and preventing undesired pressurization of a bottle having such irregularities.

According to an aspect of the invention, the said safety means comprise means for releasing the pressure in the apparatus and in the bottle if the bottle acquires shape and/or dimension irregularities as a result of expansion during the aeration.

According to another aspect, the said safety means comprise means for preventing the formation of pressure in a bottle which presents shape and or dimension irregularities.

In a preferred embodiment of the invention, the liquid aerating apparatus is provided with a reference surface, means for causing a bottle loaded on the apparatus to come into matching relationship with the reference surface, and means for preventing the build-up of pressure or releasing the pressure in the bottle, if the position of the bottle, when in such a relationship with the reference surface, does not correspond to the position of a bottle having the correct shape and dimensions.

Preferably said matching relationship is achieved through direct contact of the bottle with the reference surface, but it could be achieved otherwise, by providing any suitable intermediate elements between the bottle surface and the reference surface, or by using position comparator means or scanning means comparing the bottle profile with the reference surface, or the like.

In a further preferred embodiment, means for causing the bottle to come into contact with the reference surface are provided, which comprise means for receiving the bottle in removable engagement, said bottle receiving means comprising means for allowing the engaged bottle to become displaced towards the reference surface and abut against the same by gravity. Preferably the last mentioned means comprise a pivot coupling between said bottle receiving means and support means rigid with the body of the apparatus, said receiving means being so structured that the cumulative centre of gravity of the bottle and the bottle receiving means, when they are mutually engaged, is offset with respect to the centre of said pivot coupling, whereby to cause the weight of the bottle to urge the same towards the reference surface.

In a further preferred embodiment of the invention, the apparatus comprises at least a valve for placing the bottle and the parts of the apparatus communicating therewith in the pressurizing operation in communication with the atmosphere, when open, and means for causing said valve to be open when the axis of the bottle is not in the position in which the axis of a bottle having the standard, correct shape and size is, when such a bottle abuts against the reference surface. Said position will be called hereinafter, for brevity's sake, "the correct position". The corresponding position of said receiving means will likewise be called "the correct position of the receiving means". As will be made clear hereinafter, the correct position actually embraces a range of positions, expressing a degree of tolerance, about an ideal one.

In a preferred embodiment of the invention, the means for causing said valve to be open comprise a plunger for displacing the valve closure element from its seat and cam means fixedly carried by the apparatus frame and so shaped as to actuate said plunger when the bottle axis, and consequently the receiving means, are angularly displaced from the respective correct position. The minimum displacement angle that will cause the cam to actuate the plunger should preferably correspond to a linear displacement of the contact point of the plunger with the cam, along the surface of said cam, of at most a few millimeters, e.g. not more than 3 mm, and more preferably about 1.5 mm, if the displacement is in the direction corresponding to a bottle diameter in excess of the correct one, and not more than 2 mm and more preferably about 1 mm, if the displacement is in the opposite direction.

Preferably two valves are provided in the apparatus, both of which operate as venting valves to release pressure, even if the bottle is in its correct position, when the pressure has reached a certain threshold value, which is preferably different for the two valves, the lower value corresponding to the completion of the aerating, and both of which are cam-actuated as safety valves to release any pressure, even below the threshold value, which may exist, or prevent the creation of a pressure, when the bottle is displaced from the correct position.

Preferably, the cams and other parts of the apparatus are so structured that the said valve or valves will operate to discharge pressure and/or to prevent pressure from being built up when the bottle axis and the receiving means are displaced from the respective correct positions in either direction, whereby bottles the diameters of which are below the correct values at any part of their contour will also not be pressurized.

Preferably, the apparatus according to the invention comprises, in combination with hand-operatable means for placing a gas cylinder, loaded in it, in communication with the inside of a bottle also loaded in it, means for preventing said hand-operatable means from being actuated if the bottle axis and the bottle receiving means are not in the correct position, said last mentioned means permitting the safety valves to be actuated by a displacement of the bottle axis and bottle receiving means even if said hand-operatable means are being operated.

Other preferred or optional features of the invention will become clear as the description proceeds. In any case, it should be understood that the apparatus may incorporate any additional safety and operating features already known in the art.

BRIEF DESCRIPTION OF THE DRAWINGS

The invention will be better understood from a description of a preferred embodiment thereof, with reference to the appended drawings, wherein.

DETAILED DESCRIPTION OF AN EMBODIMENT OF THE INVENTION

Figure 1:
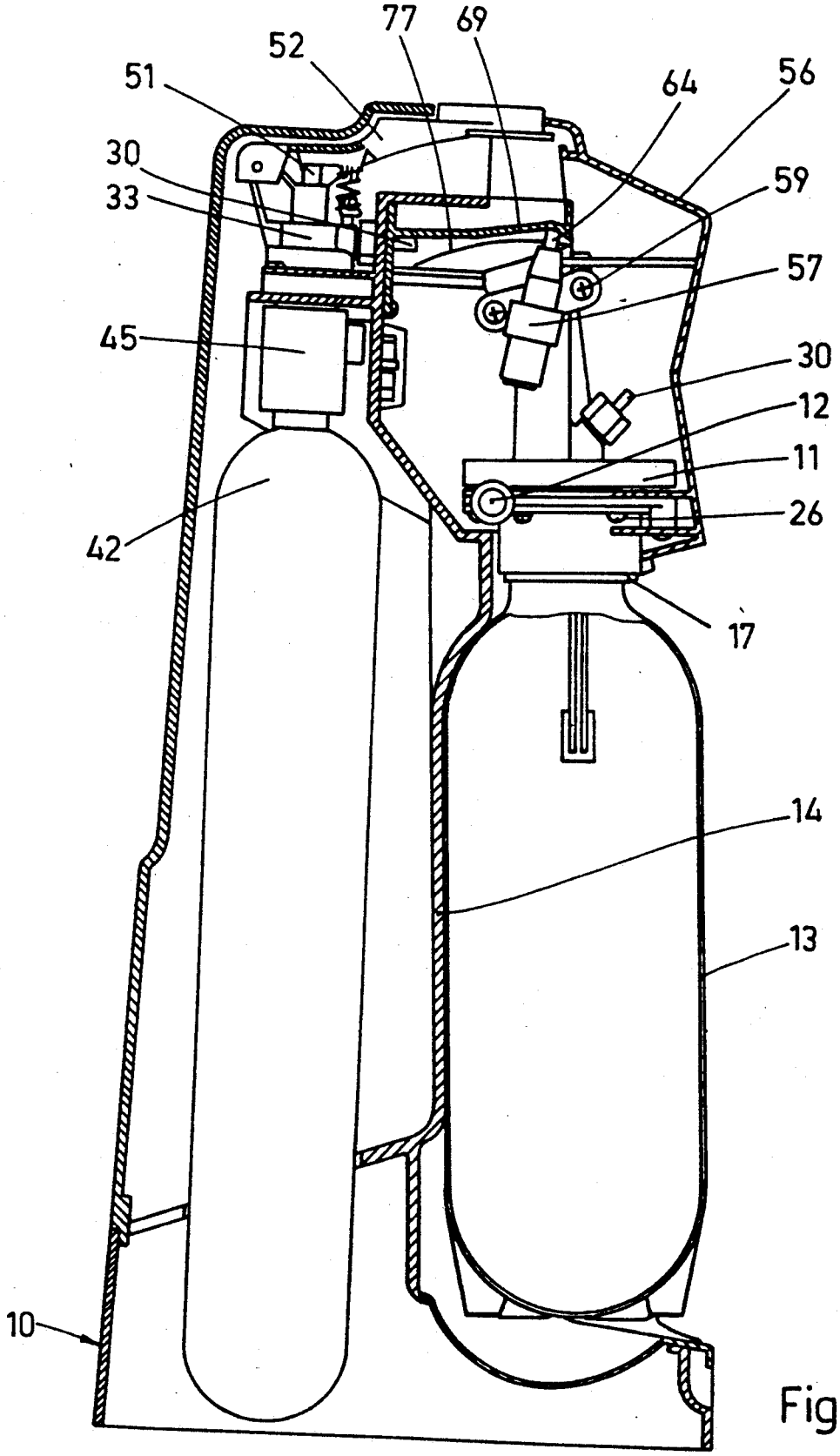
FIG. 1 is a vertical view of an apparatus according to an embodiment of the invention, parts of it being in cross-section.
Figure 2:
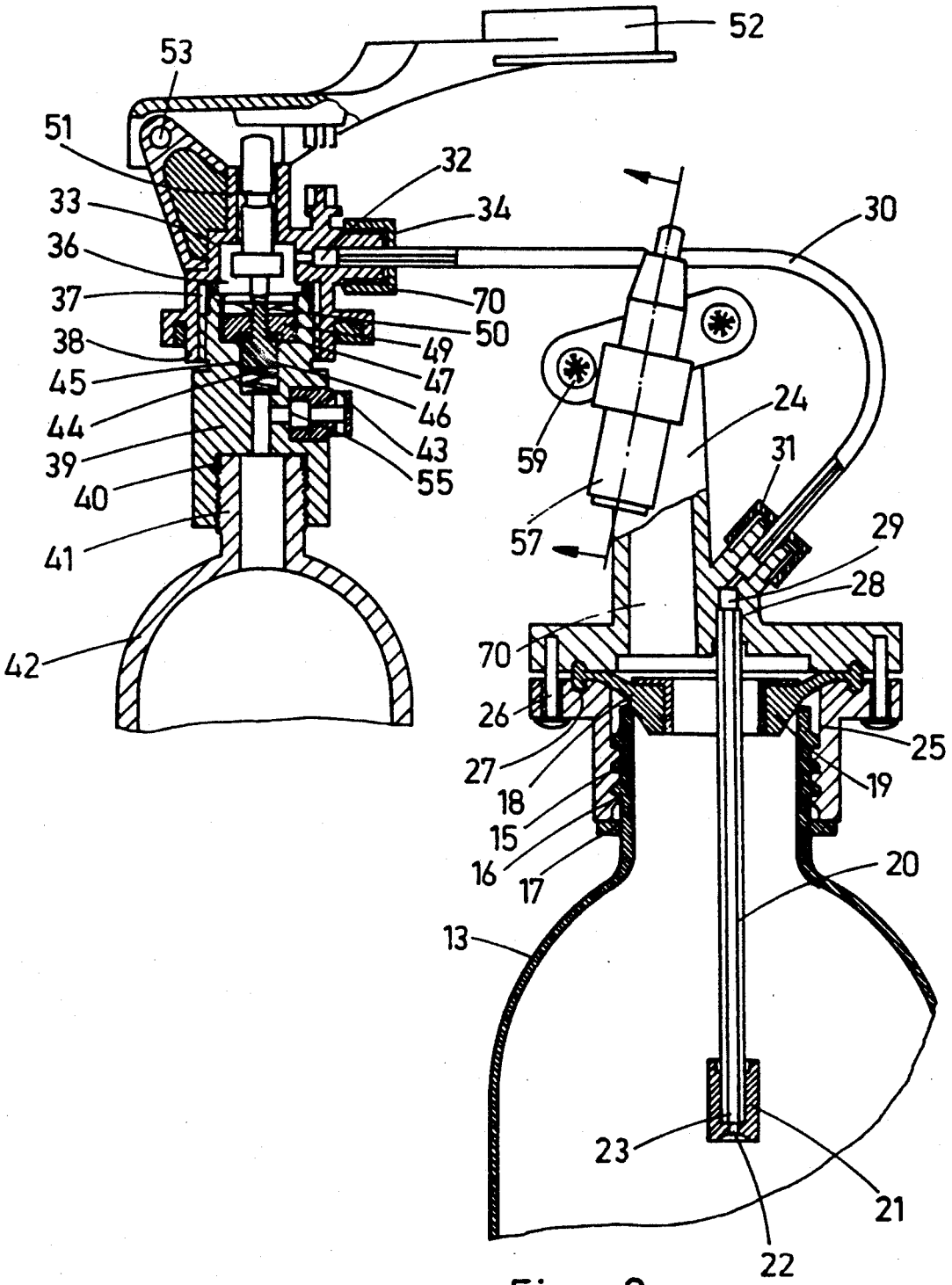
FIG. 2 is a vertical cross-section at an enlarged scale of part of the apparatus of FIG. 1.

With reference now to the drawings, an apparatus according to an embodiment of the invention comprises a main body generally indicated at 10. Mounted on said body 10 is a bottle receiving means, which is shown as an aerating head assembly 11, hinged on the body at 12 so as to be capable of being swung outwards (in counter-clockwise direction, as seen in FIG. 1) for insertion of a bottle indicated at 13. Once a bottle is fitted on said head assembly and released, it will swing back under its own weight, rotating about hinge 12, until it comes into contact with a surface 14, hereinafter called "reference surface". This occurs because the center of gravity of the bottle and aerating assembly together is offset outwardly with respect to the pivot 12. If the profile of the bottle is not as it should be, only parts thereof, particularly the parts that jut outwardly with respect to the ideal profile, will contact the surface 14. Other, direct or indirect, means could be provided by skilled persons for comparing the profile of the bottle with that of the reference surface, which could be mounted in the apparatus in a different position and in a different way, and for detecting any discrepancies between them.

The bottle 13, containing liquid to be aerated, is engaged with said head 11 and is held in engagement with the same by means of an external thread 15 provided on the bottle which engages an internal thread 16 provided in the head 11, or other suitable means, a flange 17 or like means being provided on the neck of the bottle for limiting the distance by which the bottle 13 screws into the aerating head assembly 11. When fully screwed in, the open top end of the bottle 13 contacts an elastic gasket 18, preferably made of rubber and provided with a rigid stiffening sleeve 19, or like means, with sufficient pressure to create a gas and fluid tight seal. Of course, if the bottle 13 is not correctly fitted against the gasket 18, a fluid or gas tight seal will not be effected, and the bottle will not become pressurized.

The aerating head assembly 11 accommodates a tube 20 which extends through gasket 18, against which the mouth of the neck of the bottle 13 is engaged, and down inside the bottle 13. At its lower end the tube is threaded into a jet 21 which has a small bore 22 matching with the bore of said tube at 23.

The aerating head 11 comprises an upper part 24 and a lower part 25, which is connected to the upper part in any suitable way, e.g. by means of screws 26. A suitable sealing means, in this case a ring 27, which is part of the gasket 18, insures liquid and gas tight seal between the two parts of the aerating head 11.

The upper end of tube 20 is threaded at 28 into the upper part 24 of the aerating head 11 and communicates at its upper end with a passage or bore 29, which is connected to a flexible tube 30 by a connection 31, which ends in a bore 32 of a gas cylinder holder 33 and is held therein by a connector 34. Bore 32 in turn communicates with chamber 36 of cylinder holder 33.

Cylinder holder 33 is threaded internally at 37 to receive an externally threaded boss 38 of a valve body 39 which is screwed at 40 onto the neck 41 of a small gas cylinder 42. The valve body 39 is part of a valve assembly 45 which is fitted on each gas cylinder 42, so that a used gas cylinder can be removed together with its valve assembly from the cylinder holder 33 and a fully charged cylinder with its own valve assembly 45 can be fitted in its place.

The valve body 39 has a valve chamber 44 which houses a spring 43. The valve assembly 45 further comprises a valve pin 46 bonded to a gasket 47, which pin is urged by spring 43 against a seat formed at the lower end of an insert 49, which is provided with a bore through which a projection 50 of pin 46 passes.

The cylinder holder 33 is fitted with a plunger 51 which can be depressed by an external, manually operated, swingable, finger-actuated lever 52, pivoted at 53 on said cylinder holder. Depression of lever 52 causes plunger 51 to slide downwards and press downwards projection 50 of valve pin 46, against the reaction of spring 43, whereby to permit gas to pass from cylinder 42 through the bore of insert 49 and into chamber 36 of the cylinder holder, therefrom through flexible tube 30 and then into tube 20 which extends downward into the bottle 13 containing the liquid to be aerated. When the lever 52 is released, the spring 43 reasserts itself to urge the valve pin 46 upwards against its seat and close the valve 45, concurrently returning the plunger 51 upwards to its starting position. The valve body 39 may be provided with a subsidiary safety device, such as a blow out disk 55 which acts to release excess pressure in the gas cylinder 42.

The finger actuated lever 52 can be depressed when the aerating head 11 is in the vicinity of its fully swung downwards position, which is the aerating position. This is because the aerating head 11 is solid with a plate 56 which, as seen in FIG. 1, prohibits depression of lever 52 when it is swung away from the aerating position by an angle greater than a predetermined tolerance angle, as will be explained hereinafter, whereby to prevent undesirable or unsafe discharge of gas.

Figure 3:
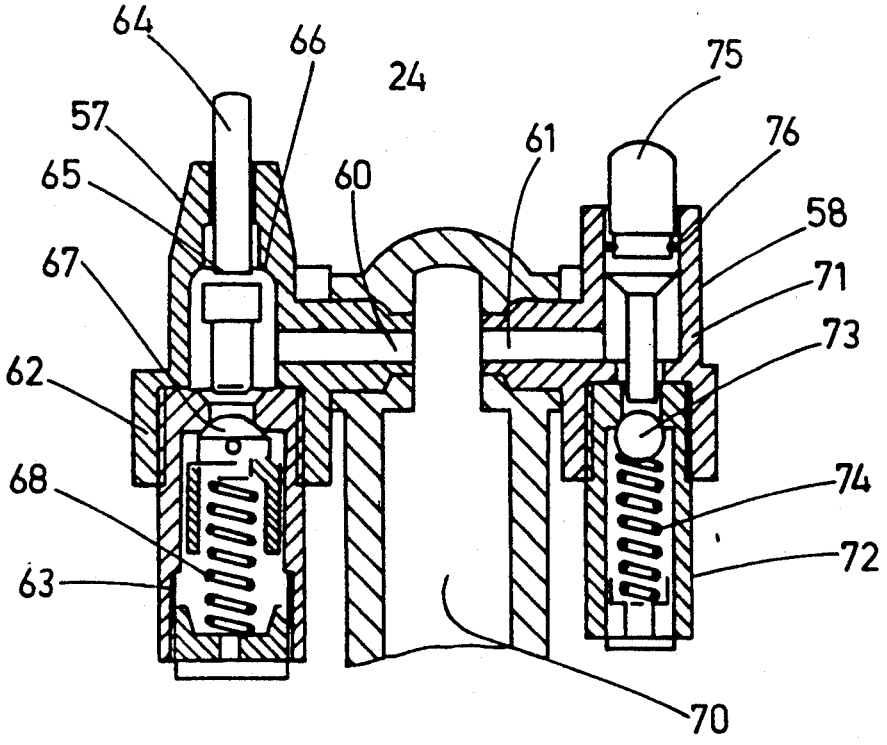
FIG. 3 is a cross-section of a detail of FIG. 2, taken on the plane III—III of FIG. 2, looking in the direction of the arrows.

The aerating head assembly 11 comprises an upper aerating head 24, fitted with a pressure release valve carrier assembly 57 and a safety valve carrier assembly 58, both fastened to the upper aerating head 24 by screws 59 and more particularly seen in FIG. 3. The inner chamber 70 of the upper aerating head 24 communicates with exhaust valve carrier assembly 57 by means of a bore 60 and with safety valve carrier assembly 58 by means of a bore 61.

The exhaust valve carrier assembly 57 comprises an exhaust valve carrier body 62, fitted with an exhaust valve 63, and a plunger 64 with a ring 65, which seals at 66 against the exhaust valve carrier body 62 when internal pressure is applied. In the absence of pressure, plunger 64 falls back due to gravity until its lower end rests lightly on a poppet 67 of the valve, which is forced against a seat by a spring 68. When pressure is applied to the system with the aerating head in its correct position, plunger 64 is urged upwards until a gas tight seal is made by ring 65 seating 66. When the pressure in the system has reached a predetermined threshold value, e.g. 105 psi, and the aerating has been completed, spring 68 will yield and the gas will be vented to the atmosphere.

Figure 4A:
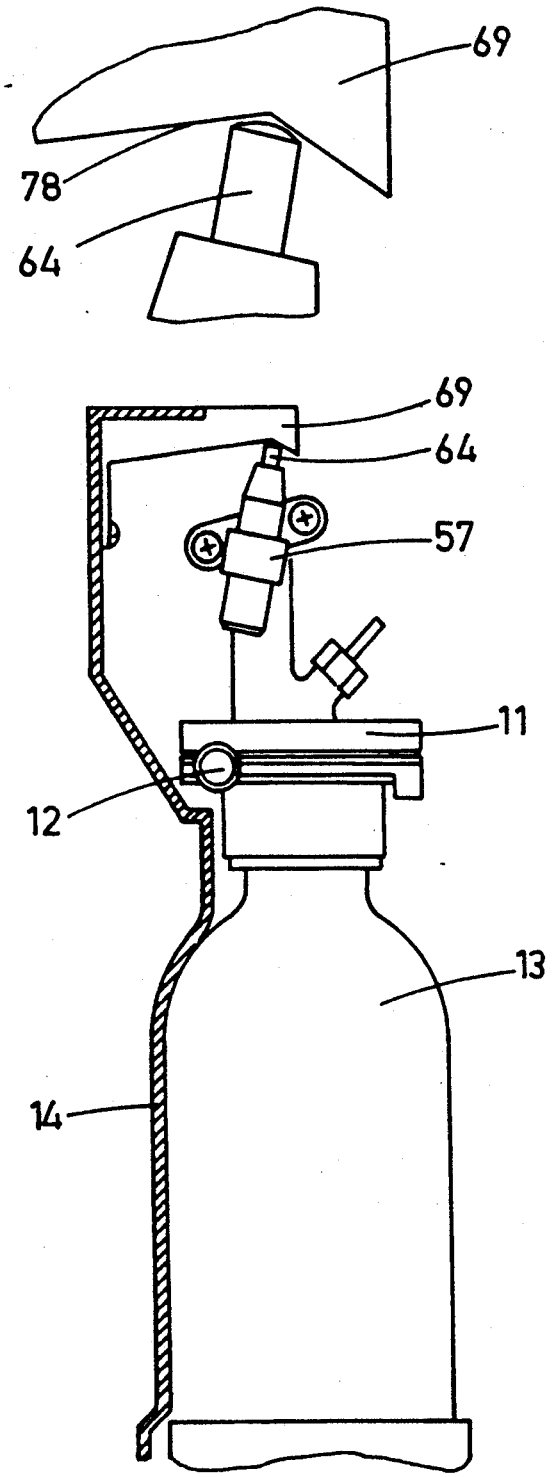
FIG. 4 (*a*), (*b*) and (*c*) is a schematic illustration, in vertical view with details shown at an enlarged scale, of how a pressure release valve, according to an embodiment of the invention, is actuated to release pressure or prevent formation thereof when the bottle, which is in the apparatus, is not in the correct position.
Figure 4B:
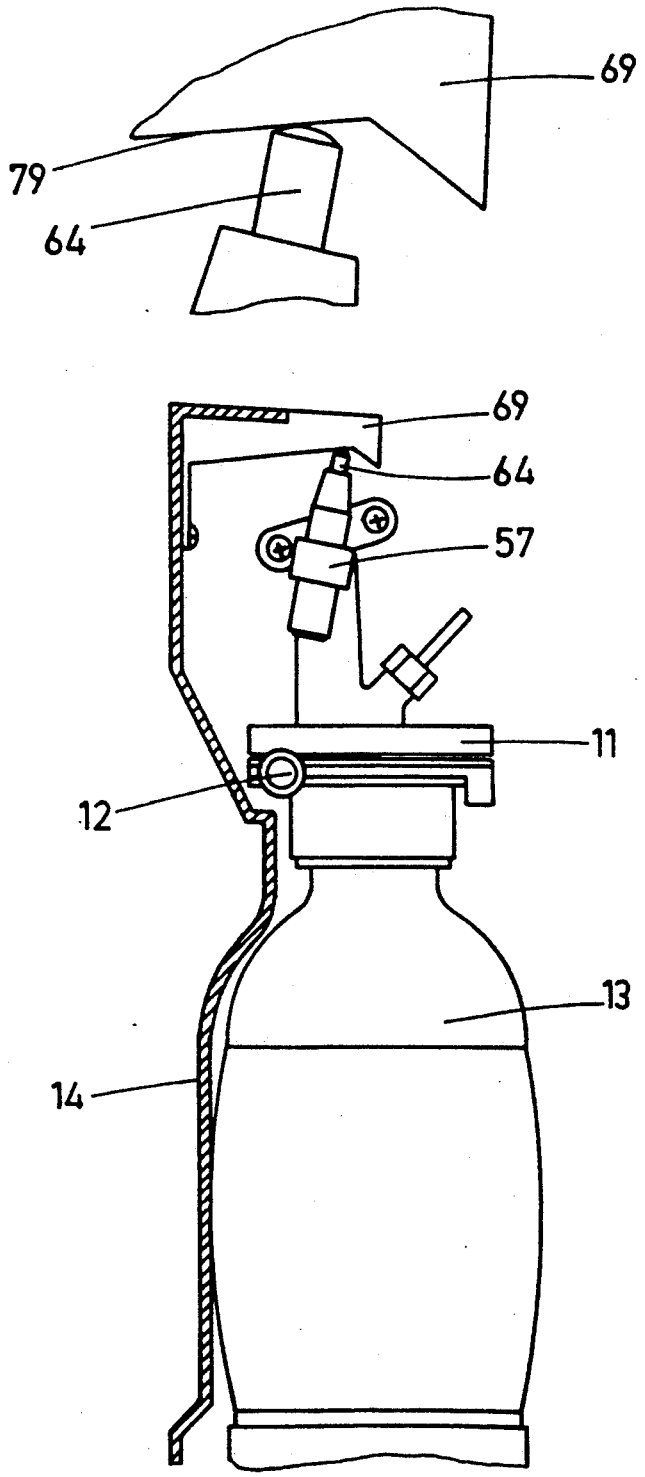
Figure 4C:
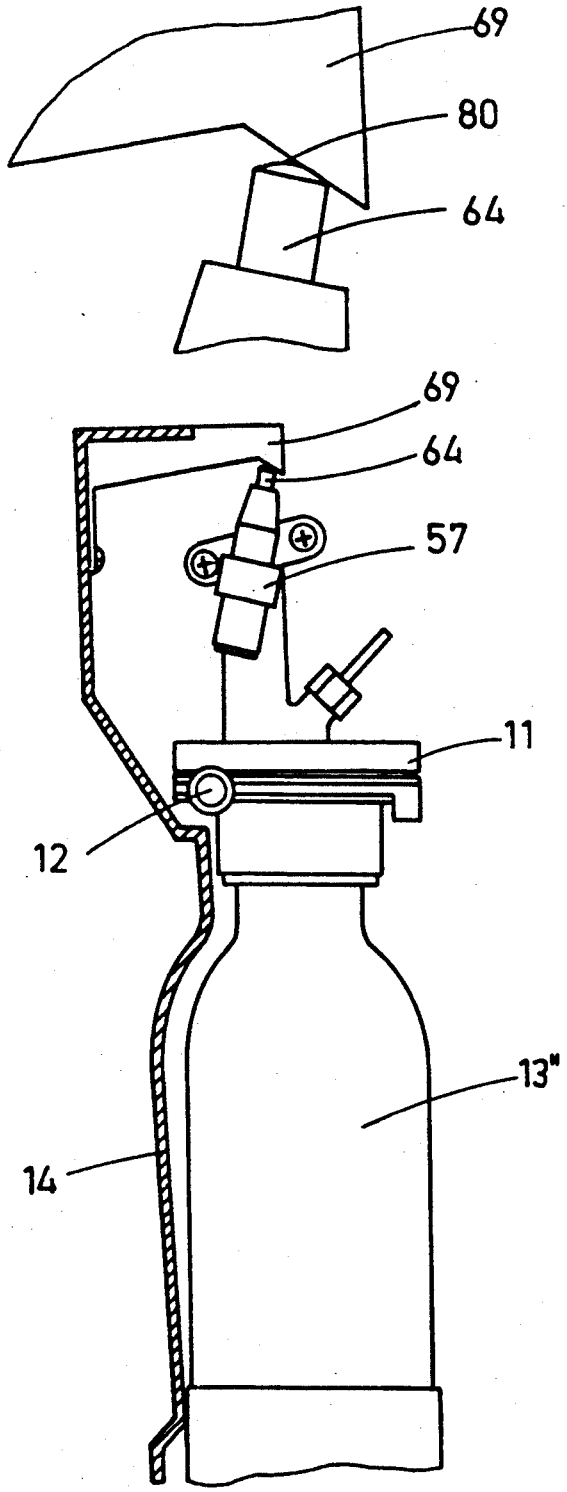

Further, independently of the degree of pressure in the bottle, when the aerating head is swung away from its correct position, plunger 64 will be depressed by cam 69 and will push ring 65 off its seat, thereby allowing pressure to escape, as gas from chamber 70 passes through the clearance between the plunger and the bore of the valve body 62. How this occurs, is schematically illustrated in FIG. 4, the cam and the plunger being also shown therein as a detail at an enlarged scale. FIG. 4 (*a*) shows a bottle 13 having the correct, standard profile, which bottle therefore is in its correct position, when loaded in the apparatus. In this case, the plunger 64 of exhaust valve assembly 57 is close to a zone 78 of cam 69, which represents a recess in the cam profile, a slight gap remaining therebetween, so that the plunger is in its uppermost position, poppet 67 engages its seat and the exhaust valve is closed (of course, if the pressure is below its threshold value). If a bottle 13' has swollen under pressure or had from the start a diameter in excess of the correct value at any point of its contour, as in FIG. 4 (*b*), the bottle will be shifted (in a counterclockwise direction, looking at the drawings) from its correct position. The point of contact of plunger 64 with cam 69 will have shifted, as shown in FIG. 4 (*b*), to the left looking at the drawing, and will now be on surface 79 of the cam, which is slanted outwards with respect to zone 78, whereby plunger 64 will have been depressed, displacing ring 65 off its seating face at 66 to release pressure. The same depression of the plunger will occur if the bottle has a diameter which is below the correct, standard value, as shown in FIG. 4 (*c*). The point of contact of plunger 64 with cam 69 will now be in portion 80 of the cam arc, to the right (looking at the drawing) of zone 78. Portion 80 is more sharply slanted outwards than portion 79, so that a smaller angular displacement of the aerating head and a smaller linear displacement of the point of contact of the plunger with the cam will now suffice to actuate the ring 65 from its seating face 66 to release pressure. Plunger 75 of safety valve 72 will cooperate in a similar manner with cam 77.

The actuation of the exhaust valve in the situation of FIG. 4 (*b*) will occur when the plunger 64 has travelled a few millimeters, preferably not more than 3 mm and still more preferably about 1.7 mm, along portion 78 of the cam arc. In the embodiment described, the initial distance of the pivot 12 from the vertex of zone 78 of cam 69 is 87 mm, and a linear displacement of the plunger of 3 mm corresponds to a displacement angle of about 2°. This figure indicates the order of magnitude of the angular displacement which actuates plunger 64 and therefore of the sensitivity of the safety device represented by ring 65 and its seating 66. Of course, the displacement angle may change depending on the dimensions of the device, and e.g. on the distance of the displacement pivot, such as 12, from the correct contact point of plunger and cam (which is the radius of the angular displacement), on the distance from said pivot to the zones of the bottle where an expansion may take place and on the extent to which such an expansion may be tolerated. The minimum linear displacement of the plunger, with respect to the pivot, that will displace ring 65 off its seat 66, as described, can also change depending on the various dimensions mentioned, but it can be easily determined by a skilled person in each particular instance, based on the typical values indicated herein.

The plunger 64 will be actuated in the same way, to displace ring 65 from its seat, if a bottle the diameter of which is greater than the correct one at any point of its contour is loaded on the machine. The aerating head will be angularly displaced from its correct position, because of the excess diameter, exactly as if a bottle having the right size and shape had been loaded and had expanded as a result of pressurization, and plunger 64 will be displaced in the same manner along cam 69 and be depressed thereby, thus displacing ring 65 from its seat. The same values of linear and angular displacements, set forth hereinbefore for the case of an expanded bottle, will apply to this case.

On the other hand, if the bottle diameter is below it correct value, the situation which is created is that of FIG. 4 (*c*) and the minimum displacement which causes displacement of ring 65 from its seat to release pressure will be in the same order of magnitude, but preferably smaller, e.g. by about one third, than that which causes such actuation in the case of FIG. 4 (*b*). E. g. its minimum value should preferably be not greater than 2 mm and still more preferably should be about 1 mm.

Considering now the aerating of a bottle of correct dimensions, pressure is released once the aerating has been completed and the pressure threshold has been reached, and then the bottle is swung with the aerating head in the direction required to unload the bottle—counterclockwise, as seen in the drawings. This swinging of the aerating head continues beyond the angle which actuates valve 63, and at that time, and before a position is reached in which it is possible to remove the bottle from the apparatus, the plunger 64 will be pushed down by cam 69 and will displace poppet 67 from its seat. This will not normally vent any pressure, as pressure should normally have been released already, but provides an additional safety in case of any malfunction that might have caused any pressure to remain in the system. Further, in the case that the poppet had become stuck to its seat, due to the machine's not having been used for some time or for any other cause, it will be freed when the plunger 64 is depressed by the cam 69 as the aerating head is swung forward for the purpose of inserting a bottle, and this will guarantee that the valve operates properly when the system is pressurized.

The safety valve assembly 58 comprises safety valve carrier body 71 fitted with a safety, pressure release valve 72 which comprises a valve ball 73 and a spring 74 urging the ball 73 against its seat. In the body 71 a plunger 75, provided with a rubber ring 76, is slidably mounted. When a predetermined threshold pressure, marginally higher than the threshold pressure of the exhaust valve, e.g. 130 psi, has been reached because the exhaust valve has not released it for any reason, spring 74 will yield, valve ball 73 will be displaced from its The reference surface 14 is so formed that when a bottle having the correct shape and size and correctly screwed onto the aerating head 11 rests against it, cams 69 and 77 will not actuate plungers 64 and 75 and the release and safety valves will not be opened by them. The inside of the bottle and the parts of the apparatus in communication with it will be sealed off from the atmosphere and actuation of the lever 52 will cause gas to pass from the cylinder 42 to the bottle, until the predetermined maximum pressure has been reached.

It is appreciated that it is the engagement of the bottle surface with the reference surface 14 which determines the position of the bottle axis, and since this is necessarily aligned with the axis of the aerating head, determines the position of the aerating head. The "correct positions" of both are those which they assume when a bottle having the correct shape and size has come into contact with reference surface 14. However, there is a certain tolerance in the bottle's shapes and sizes, and therefore minor departures from the theoretical position, corresponding to an ideal perfect bottle, are tolerated, so that the expression "correct position" should be understood as including all positions differing from the ideal one by a tolerated amount. The tolerated amount is expressed by an angular tolerance, defined as the angle by which the bottle and the aerating head must be displaced from the ideal position to cause the cams 69 and 77 to actuate the venting and safety valves, and thus to prevent pressurization of a defective bottle or to interrupt the pressurization of a bottle which has expanded beyond the tolerated amount, as set forth hereinbefore.

Obviously, when the liquid in the bottle has been completely aerated and the bottle is swung upwards in order to remove it from the apparatus, the swinging motion will bring plungers 64 and 75 into engagement with cams 69 and 77 and the pressure in the bottle and the apparatus will be released. Concurrently plate 56 reaches a position in which it prevents lever 52 from being depressed and thus prohibits release of gas into the apparatus. However the angle by which the aerating head must be swung away from its correct position for plate 56 completely to prevent depression of lever 52, is substantially larger than the angle by which it must be swung for cam 69 to actuate plunger 64, e.g. it should be no less than 5°. Therefore the plungers and their valves can be actuated, as a result e.g. of a swelling of the bottle, even though lever 52 is still being depressed to effect pressurization. This is important because the a frame;

a reference surface contained in said frame;

bottle receiving means, contained in said frame, for securing a bottle to said frame at an open top end of said bottle, said bottle having a central axis that intersects said open end;

means for urging said bottle in contact with said reference surface such that said axis is parallel to said reference surface; and means for preventing build-up of pressure in said bottle if said axis is displaced with respect to said reference surface.

2. The apparatus of claim 1 wherein said means for urging said bottle comprises arrangement of said bottle receiving means such that the cumulative center of gravity of said bottle receiving means and of said bottle in said bottle receiving means is offset with respect to a center of said bottle receiving means, whereby the weight of said bottle urges said bottle towards said reference surface.

3. The apparatus of claim 1 wherein said bottle receiving means comprises a pivot coupling which is capable of angular displacement.

4. The apparatus of claim 1 wherein said bottle receiving means comprises a valve for placing said bottle in pressurizing operation and means for opening said valve when said axis of said bottle is angularly displaced with respect to said bottle receiving means.

5. The apparatus of claim 4 wherein the opening means comprises a plunger for opening said valve and a cam in contact with said plunger, said cam shaped so as to actuate said plunger when said axis of said bottle is angularly displaced from said bottle receiving means.

6. The apparatus of claim 5, wherein said bottle receiving means further comprises an exhaust valve to release pressure even if said bottle is not angularly displaced when the pressure in said bottle has reached a threshold value and the aerating has been completed.

* * * * *